US010205278B2

(12) United States Patent
Sone et al.

(10) Patent No.: US 10,205,278 B2
(45) Date of Patent: Feb. 12, 2019

(54) CONNECTOR CONNECTING DEVICE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kosuke Sone, Mie (JP); Osamu Nakayama, Mie (JP); Mitsuhiro Shimamura, Mie (JP); Yuji Kawashima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/750,921

(22) PCT Filed: Jul. 19, 2016

(86) PCT No.: PCT/JP2016/071114
§ 371 (c)(1),
(2) Date: Feb. 7, 2018

(87) PCT Pub. No.: WO2017/026231
PCT Pub. Date: Feb. 16, 2017

(65) Prior Publication Data

US 2018/0241153 A1 Aug. 23, 2018

(30) Foreign Application Priority Data

Aug. 7, 2015 (JP) ..... 2015-156745

(51) Int. Cl.
*H01R 13/631* (2006.01)
*H01R 13/42* (2006.01)
(Continued)

(52) U.S. Cl.
CPC ..... *H01R 13/631* (2013.01); *H01R 13/42* (2013.01); *H01R 13/502* (2013.01); *H01R 13/533* (2013.01); *H01R 43/26* (2013.01)

(58) Field of Classification Search
CPC .... H01R 13/631; H01R 13/42; H01R 13/502; H01R 13/533
See application file for complete search history.

(56) References Cited

U.S. PATENT DOCUMENTS 7,189,101 B2 * 3/2007 Nagashima ..... H01R 13/6315 439/374
2005/0282426 A1 * 12/2005 Nagashima ..... H01R 13/6315 439/374

FOREIGN PATENT DOCUMENTS

JP 5303378 10/2013
JP 2014-127308 7/2014
JP 2014-127309 7/2014

OTHER PUBLICATIONS

International Search Report dated Oct. 18, 2016.

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

It is aimed to improve connector connecting operability. A connector connecting device includes a connector holder (10) disposed on a body (90) of an automatic transmission while holding a plurality of holder-side connectors (50) and configured to collectively arrange the respective holder-side connectors (50) at positions corresponding to device-side connectors (82). The connector holder (10) includes holding portions (19) each configured to hold the holder-side connector (50) displaceably to an aligned position for aligning the holder-side connector (50) in a state connectable to the
(Continued)

device-side connector (82) and a push-in position for connecting the holder-side connector (50) to the device-side connector (82) by the holder-side connector (50) being pushed from the aligned position.

6 Claims, 15 Drawing Sheets

(51) Int. Cl.

| | |
|---|---|
| ***H01R 43/26*** | (2006.01) |
| ***H01R 13/533*** | (2006.01) |
| ***H01R 13/502*** | (2006.01) |

CONNECTOR CONNECTING DEVICE

BACKGROUND

Field of the Invention

The invention relates to a connector connecting device used in connecting holder-side connectors to device-side connectors.

Description of the Related Art

Techniques are known for absorbing mutual positional deviations when connecting connectors. For example, Japanese Patent No. 5303378 discloses a connector with an outer housing to be fixed to a case, an inner housing to be inserted into an accommodating portion of the outer housing and springs arranged in the accommodating portion and configured to mount the inner housing displaceably into the accommodating portion. The springs are arranged between the accommodating portion and the inner housing. The inner housing is connectable to a mating connector and positional deviation between the inner housing and the mating connector at the time of connection can be absorbed by the springs.

A positional deviation is likely to occur when connecting a connector to a mating connector in an electrical device, such as a solenoid of an automatic transmission. Thus, if the connector and springs are accommodated in a case and the connector is supported resiliently on the case via the springs by applying the technique of Japanese Patent No. 5303378, positional deviation between the connector and the mating connector can be absorbed. However, even if the positional deviation can be absorbed, a connecting operation cannot smoothly proceed if resilient reaction forces of the springs continue to act on the connector in the process of connecting the connector to the mating connector.

Further, the presence of plural solenoids in an automatic transmission make a connecting operation cumbersome and, an operator tends to get confused or erroneously connect if the connector connecting operation is performed individually for a mating connector of each solenoid.

The invention was completed on the basis of the above situation and aims to improve connector connecting operations.

SUMMARY

A connector connecting device of the present invention is for connecting holder-side connectors to device-side connectors respectively provided in electrical devices in an automatic transmission and includes a connector holder disposed on a body of the automatic transmission while holding the holder-side connectors. The connector holder is configured to arrange the respective holder-side connectors at positions corresponding to the device-side connectors. The connector holder includes holding portions each configured to hold the holder-side connector displaceably to an aligned position for aligning the holder-side connector in a state connectable to the device-side connector and a push-in position for connecting the holder-side connector to the device-side connector by the holder-side connector being pushed from the aligned position. Each of the holding portions includes two stoppers spaced in a push-in direction of the holder-side connector, and a moving space is secured between the stoppers for allowing the holder-side connector to move toward the device-side connector.

When the connector holder is arranged on the body of the automatic transmission, the respective holder-side connectors collectively are arranged at the positions corresponding to the device-side connectors and the alignment of the holder-side connectors with respect to the device-side connectors and a connecting operation can be performed successively and smoothly by the holding portions of the connector holder. Thus, connecting operability is excellent.

The holder-side connector may include a part projecting from the connector holder at the aligned position. According to this configuration, the holder-side connector easily can be brought to the push-in position by an operator pushing the projecting part of the holder-side connector.

The connector holder includes conductor supporting surfaces for supporting conductive members extending from the connectors. According to this configuration the connector holder has both a function as the connecting device described above and a function of supporting the conductive members. Thus, an entire structure can be simplified as compared to the case where these functions are provided by separate components.

The connector holder includes conductor restricting pieces provided to cover the conductive members by facing toward sides where the conductor supporting surfaces are located. According to this configuration, the lift of the conductive members from the conductor supporting surfaces can be restricted by the conductor restricting pieces. The conductive members can be prevented from being jammed and the device can be reduced in height. Further, if the conductive members are wires, it is not necessary to use a tie band or the like. Thus, a cumbersome wire bundling operation or the like can be omitted.

DETAILED DESCRIPTION

Figure 1:
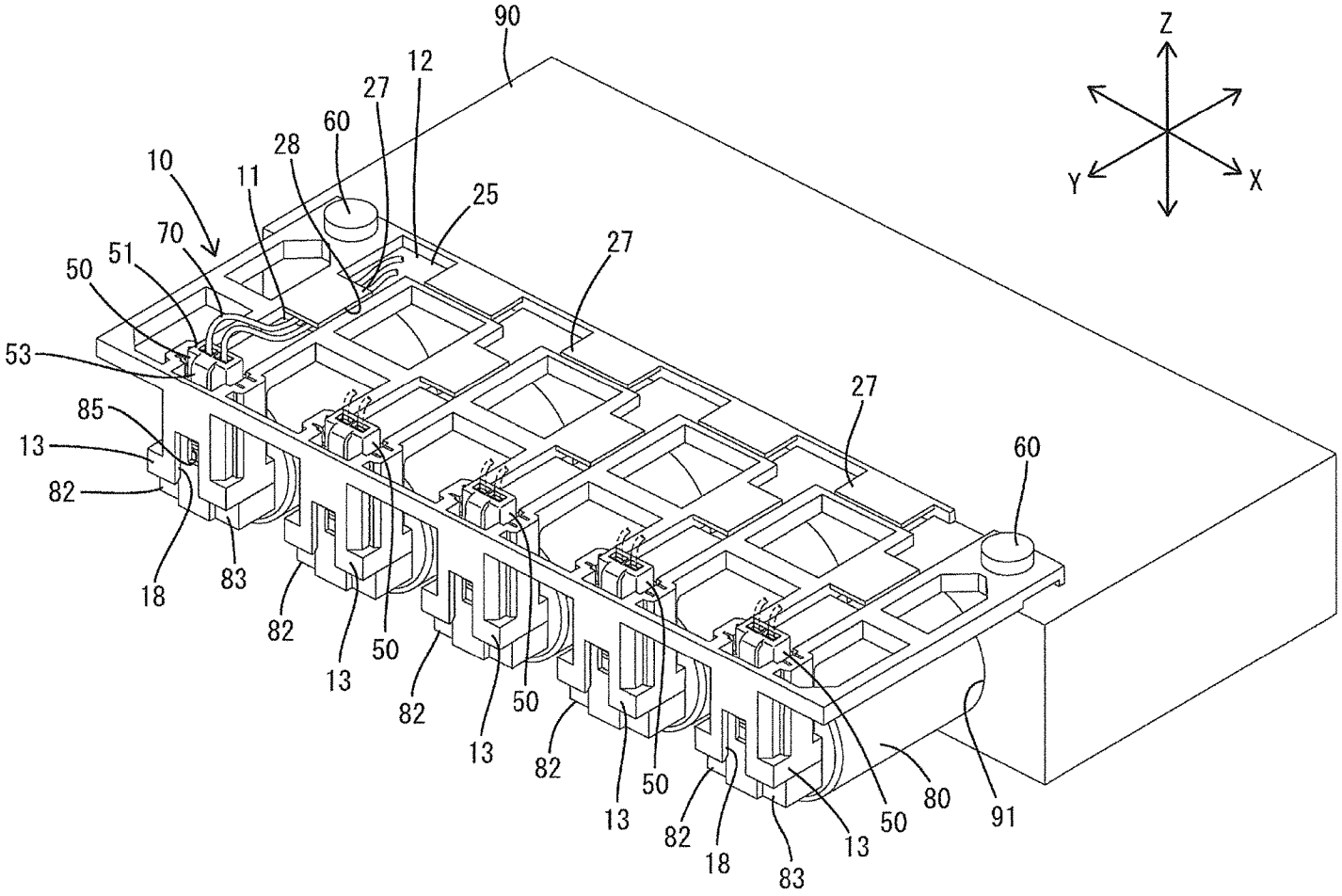
FIG. 1 is a perspective view showing a state where a connector holder is mounted on a body of an automatic transmission and each holder-side connector is held at an aligned position by a holding portion in a connector connecting device of an embodiment of the present invention.
Figure 2:
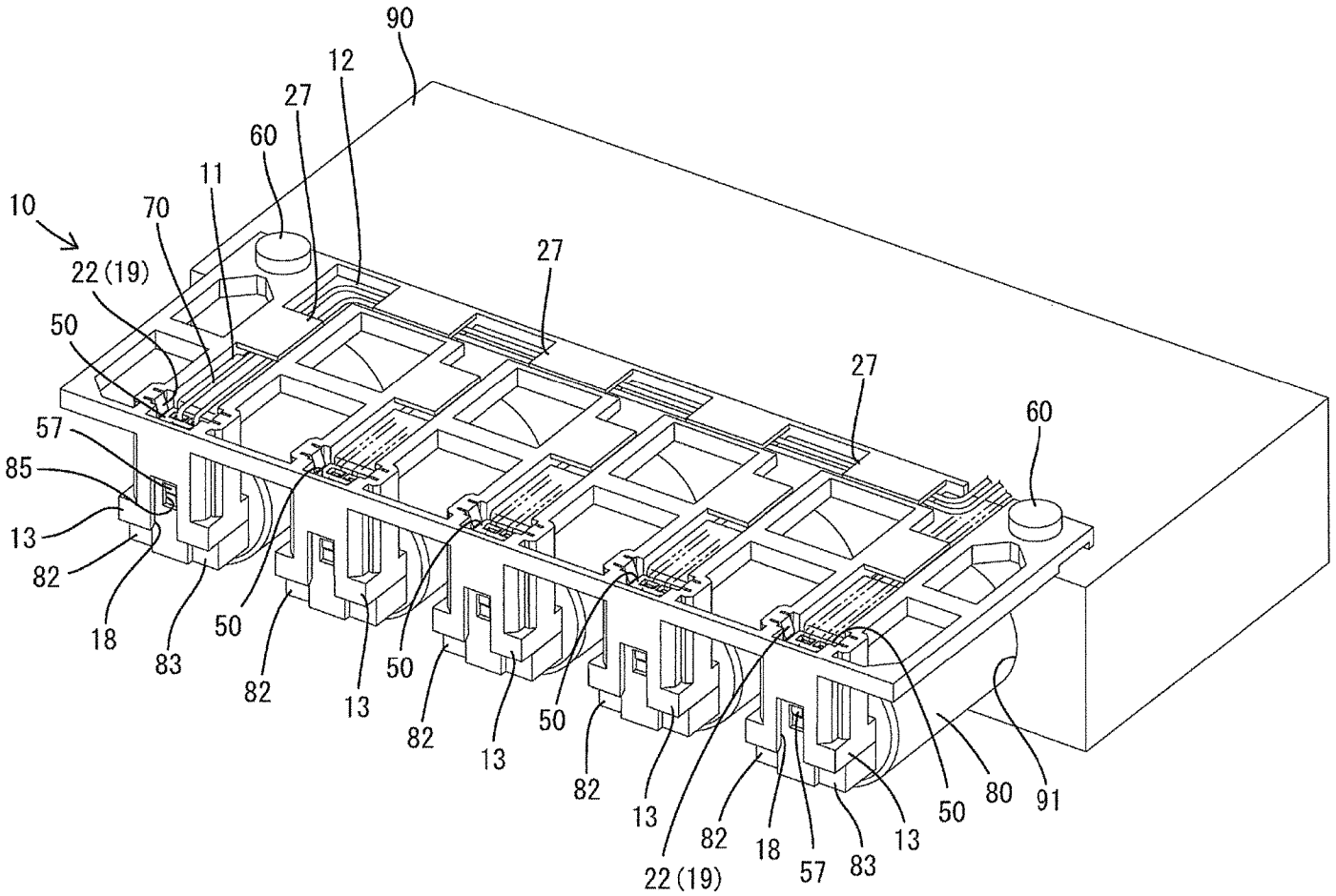
FIG. 2 is a perspective view showing a state where each holder-side connector is pushed to a push-in position from the state of FIG. 1 and properly connected to a device-side connector.
Figure 3:
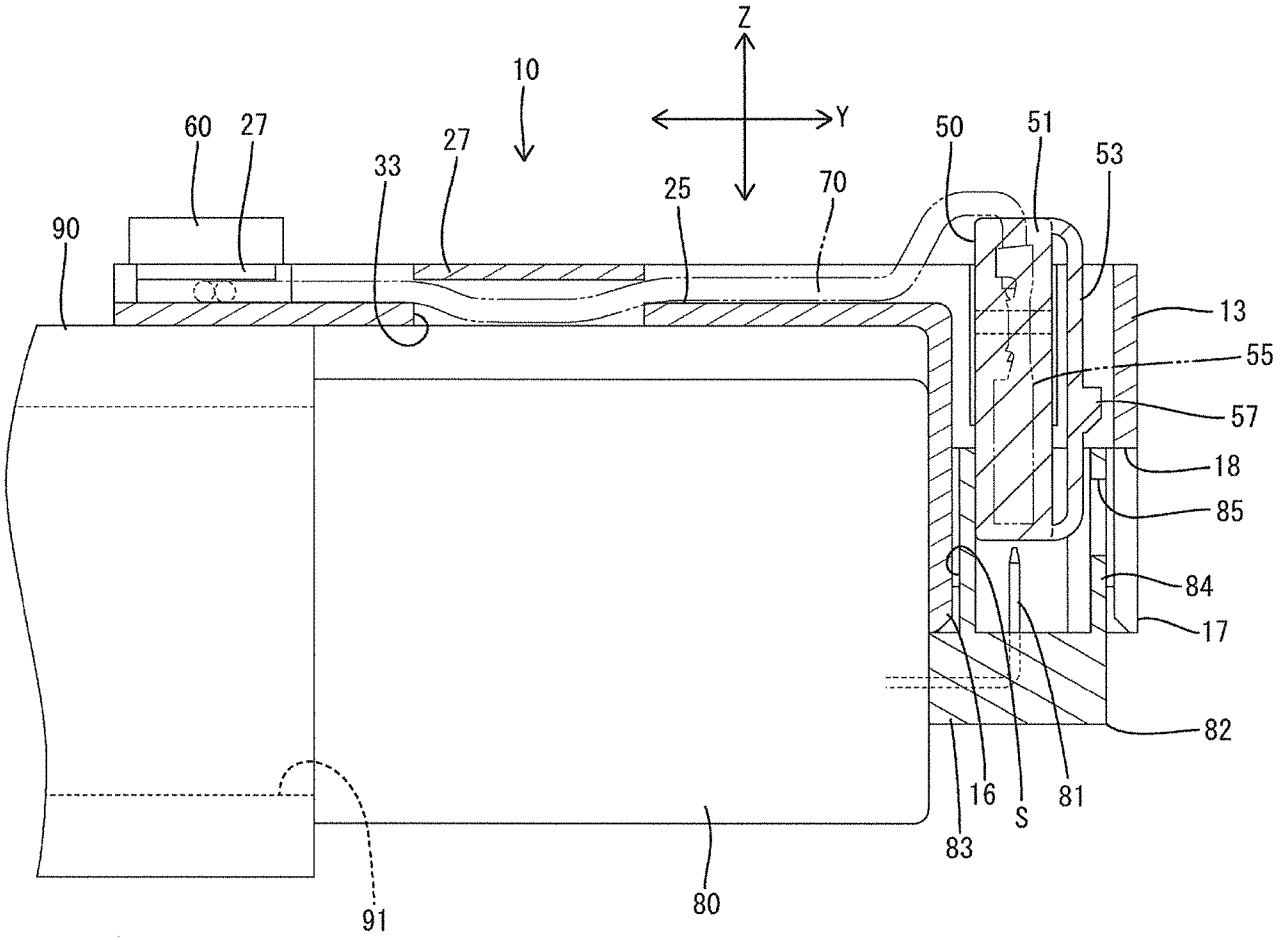
FIG. 3 is a side view in section showing the state of FIG. 1.

An embodiment of the present invention is described below with reference to FIGS. 1 to 15. A connector connecting device of the embodiment is illustrated to be a connector holder 10 to be mounted entirely on an automatic transmission of an unillustrated automotive vehicle. As shown in FIG. 1, a plurality of holder-side connectors 50 are held in the connector holder 10 and wires 70 extending from each holder-side connector 50 are supported. Note that, in the following description, a vertical direction is based on a state mounted in the automotive vehicle and is a direction along a direction of gravity. Further, a right side when the plane of FIG. 3 is viewed from above is referred to as a front concerning a front-rear direction. Further, as shown by arrows, a Z direction is an upward direction, a Y direction is a forward direction and an X direction is a rightward direction.

The automatic transmission includes a body 90 (including a case of the automatic transmission) as shown in FIG. 1. Solenoids 80 for hydraulic control are assembled with the body 90. The solenoid 80 has a hollow cylindrical shape and is inserted into a valve inserting portion 91 open in the front surface of the body 90 and fixed to the body 90 by an unillustrated pin or the like. The solenoid 80 is rotatable in the valve inserting portion 91 after being fixed by the pins. Further, the solenoids 80 are arranged laterally in a row on the front surface of the body 90.

Figure 5:
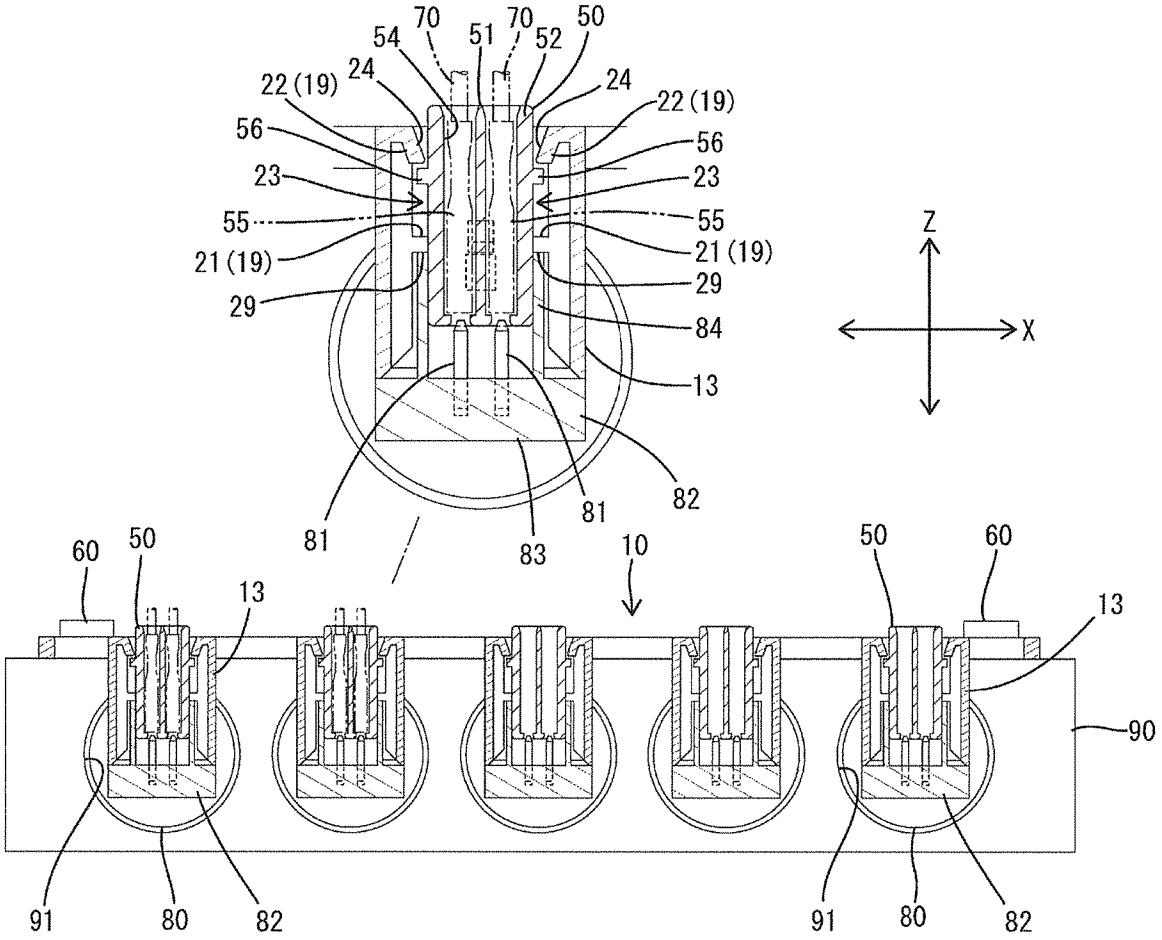
FIG. 5 is a front view in section showing the state of FIG. 1.
Figure 6:
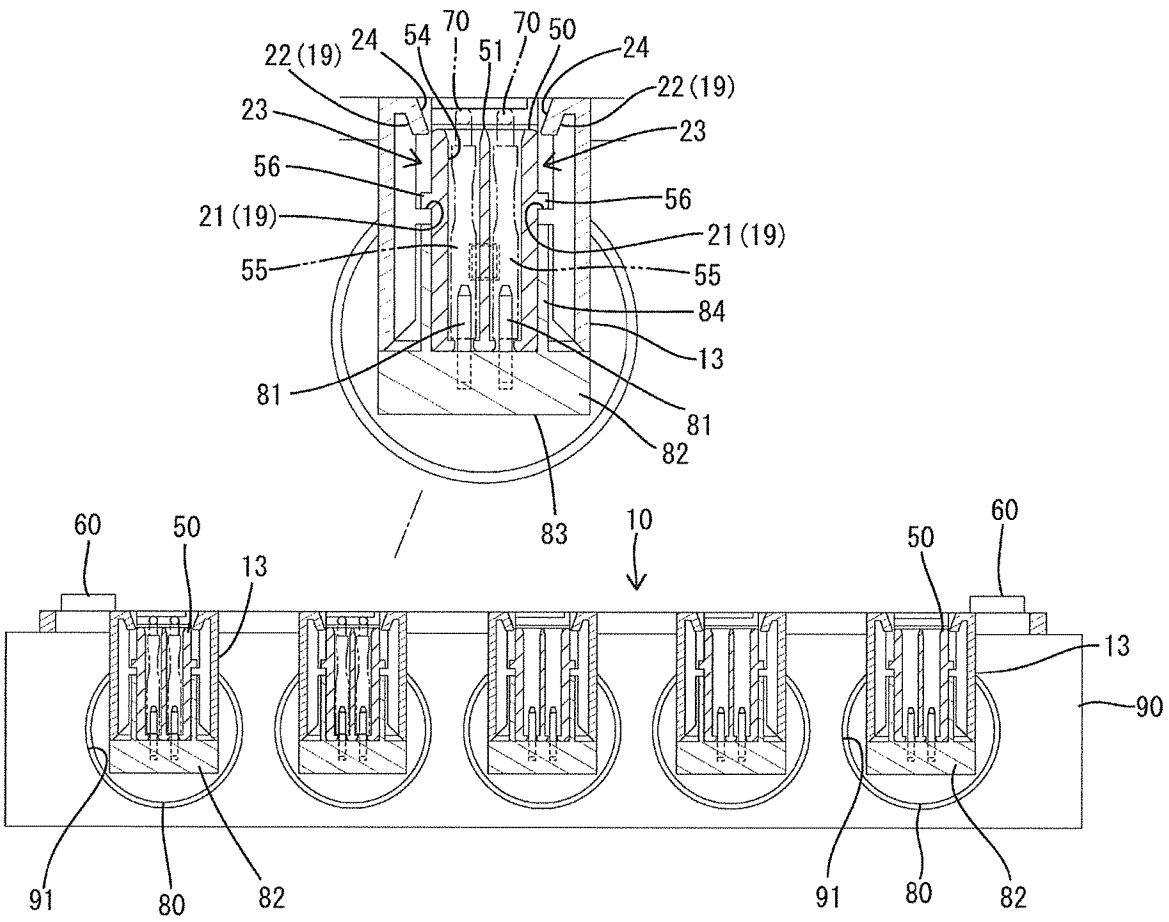
FIG. 6 is a front view in section showing the state of FIG. 2.
Figure 14:
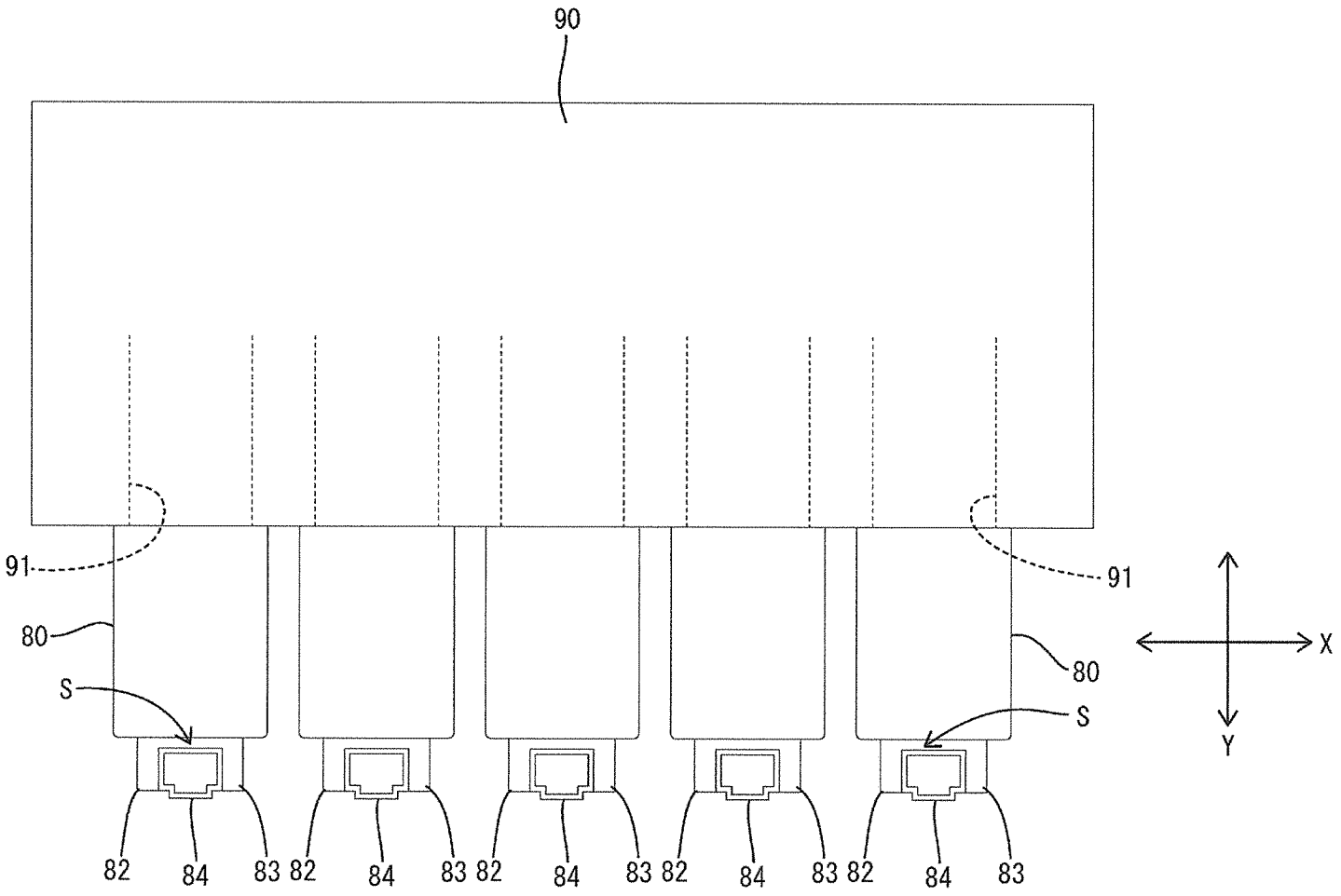
FIG. 14 is a top view showing a state of FIG. 13.
Figure 15:
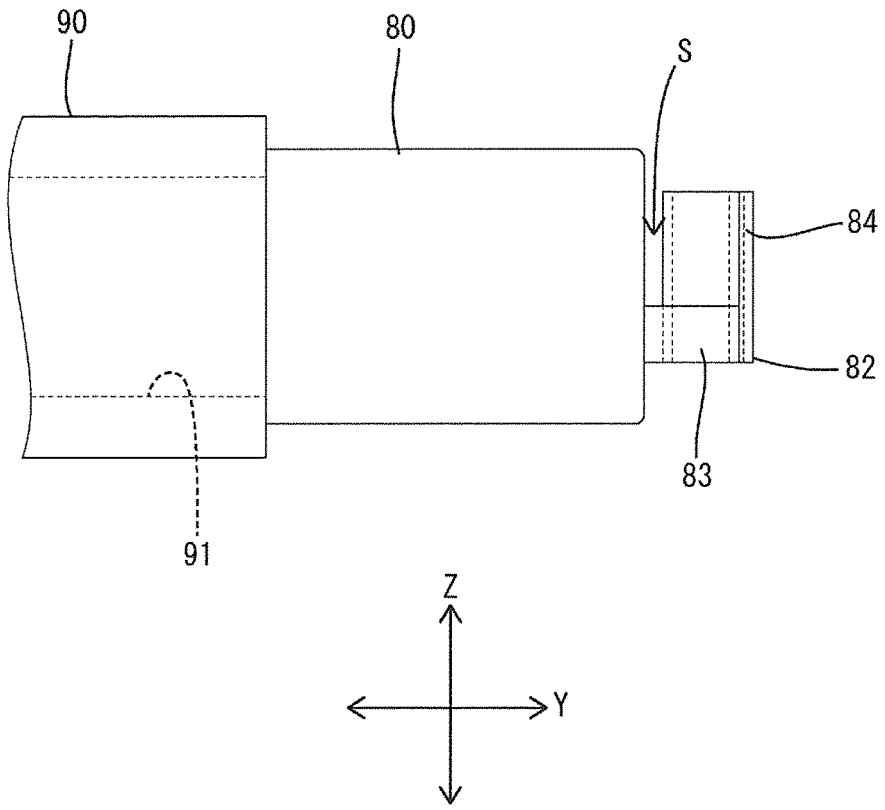
FIG. 15 is a side view showing the state of FIG. 13.

As shown in FIGS. 3 and 5, each solenoid 80 is provided integrally with a device-side connector 82 mounted with mating terminals 81 to be electrically connected to unillustrated coils inside. As shown in FIGS. 14 and 15, the device-side connector 82 includes a coupling 83 projecting forward from the front end surface of the solenoid 80, which is perpendicular to the outer peripheral surface of the solenoid 80 and a receptacle 84 projects up from the coupling 83. A clearance S is formed between the front end surface of the solenoid 80 and the receptacle 84. The receptacle 84 is open up and the tab-like mating terminals 81 are arranged to project up inside. A lock hole 85 penetrates through the front wall of the receptacle 84 in the front-rear direction.

Figure 10:
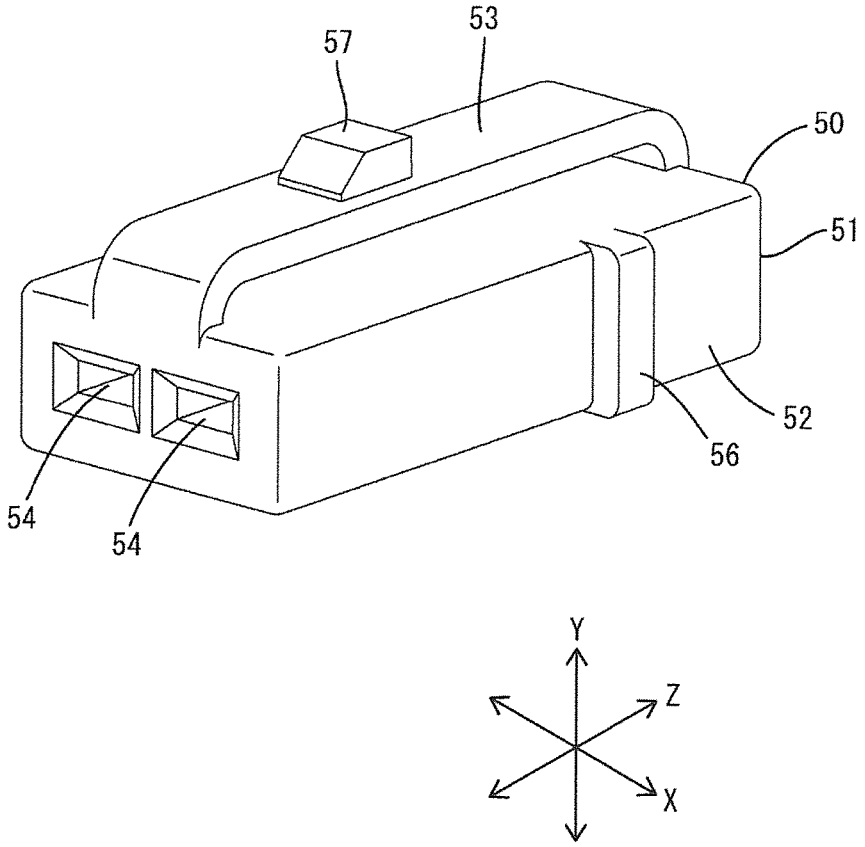
FIG. 10 is a perspective view of a housing.
Figure 11:
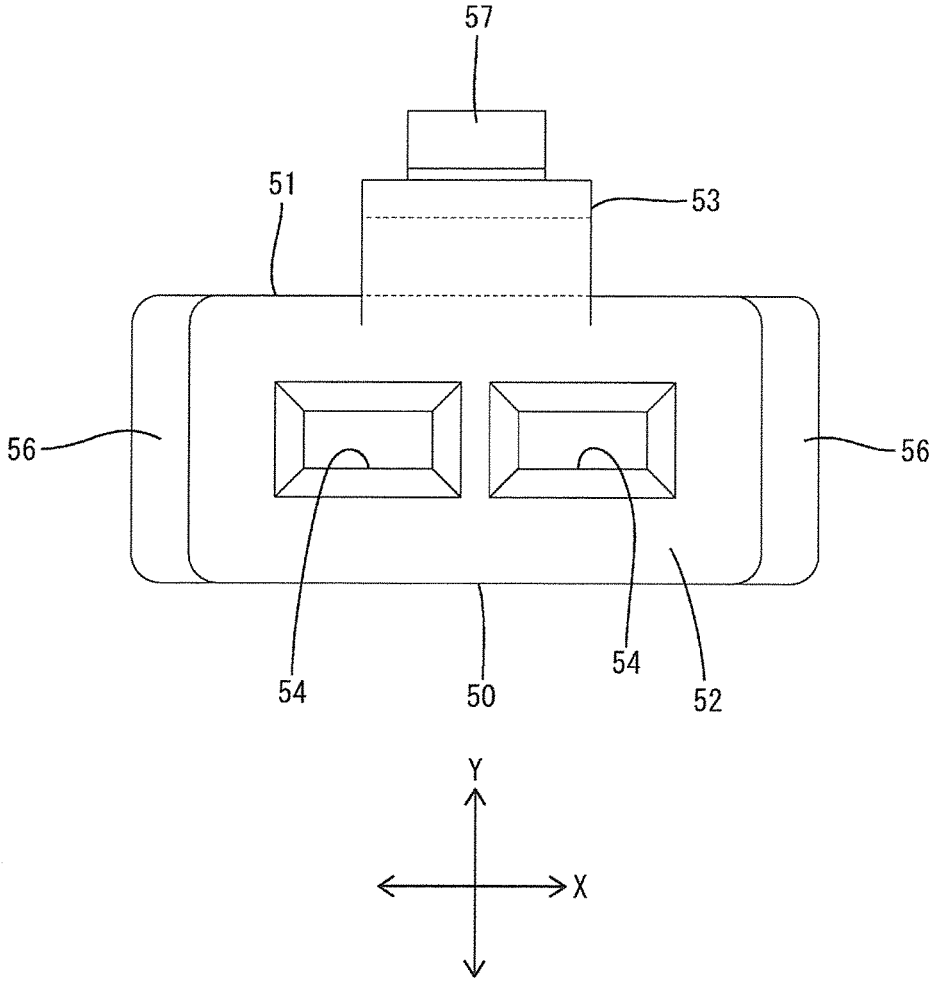
FIG. 11 is a front view of the housing.

The holder-side connector 50 includes a housing 51 made of synthetic resin and is to be inserted into the receptacle 84 of the device-side connector 82. As shown in FIG. 10, the housing 51 includes a housing body 52 in the form of a rectangular block long in the vertical direction and a lock arm 53 in the form of a beam supported on both ends and extending between both upper and lower ends of a front surface side of the housing body 52.

The housing body 52 is provided with two laterally arranged cavities 54 extending in the vertical direction and open in both upper and lower surfaces. As shown in FIG. 5, a terminal fitting 55 is inserted into each cavity 54 from above.

The terminal fitting 55 is made of electrically conductive metal and connected to an end part of the wire 70. When the holder-side connector 50 is connected to the device-side connector 82 and the terminal fittings 55 are connected to the mating terminals 81 (see FIG. 5), electrical signals from an unillustrated CPU are transmitted to the solenoid 80 via the wires 70.

Figure 12:
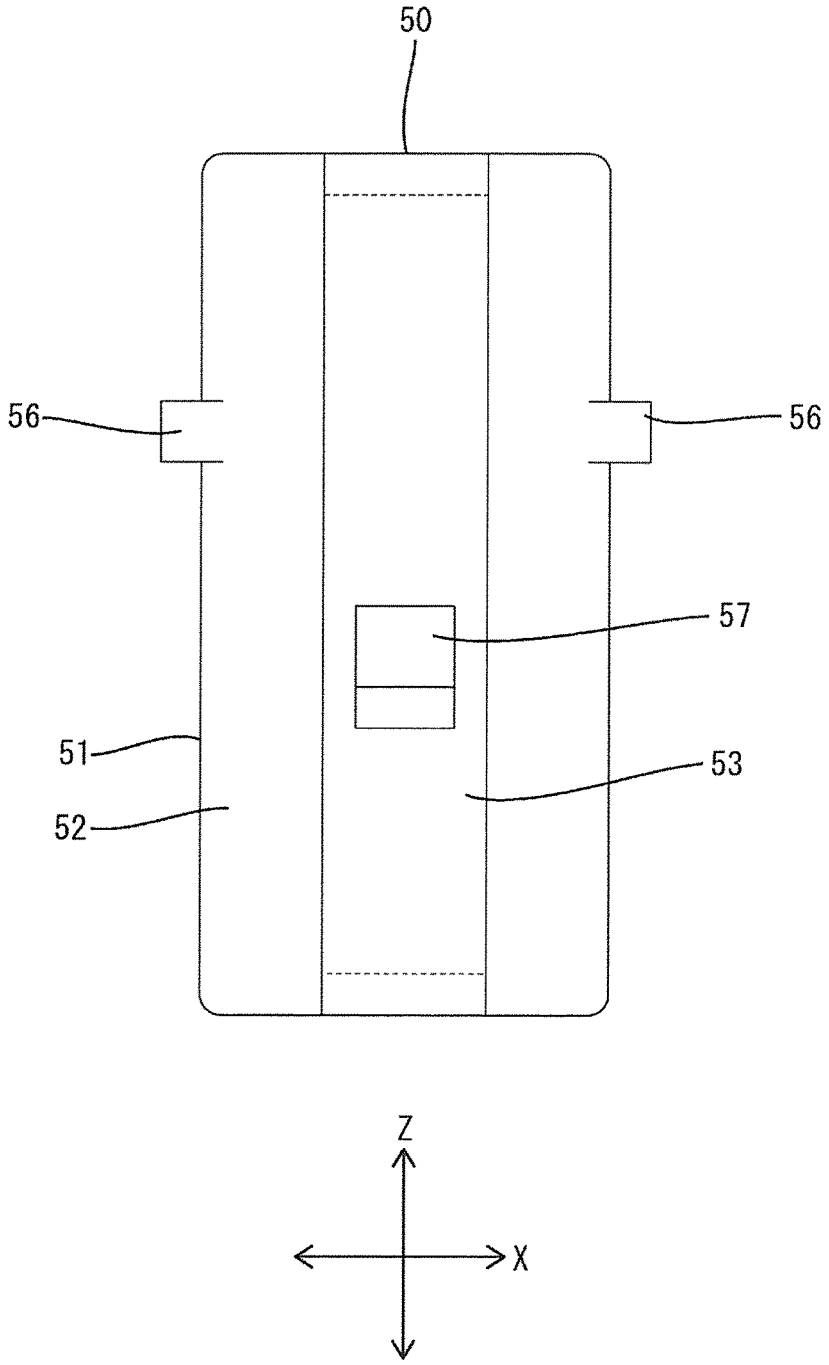
FIG. 12 is a plan view of the housing.
Figure 13:
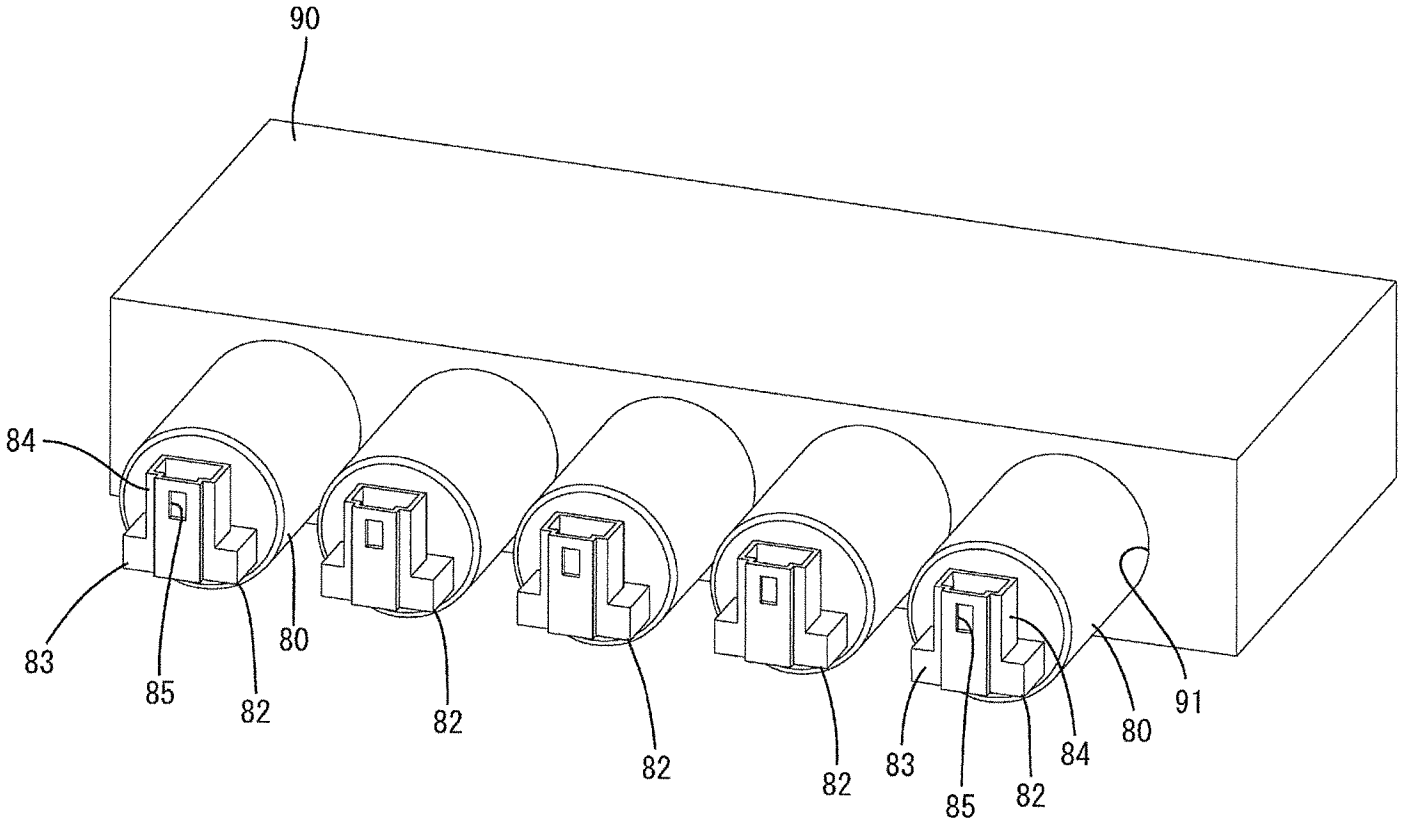
FIG. 13 is a perspective view showing a state where each solenoid integrally provided with the device-side connector is assembled with the body of the automatic transmission.

As shown in FIG. 12, two engaging portions 56 project on upper parts of both left and right side surfaces of the housing body 52. The engaging portions 56 are in the form of ribs extending in the front-rear direction and are engageable with later-described holding portions 19 of the connector holder 10.

Figure 4:
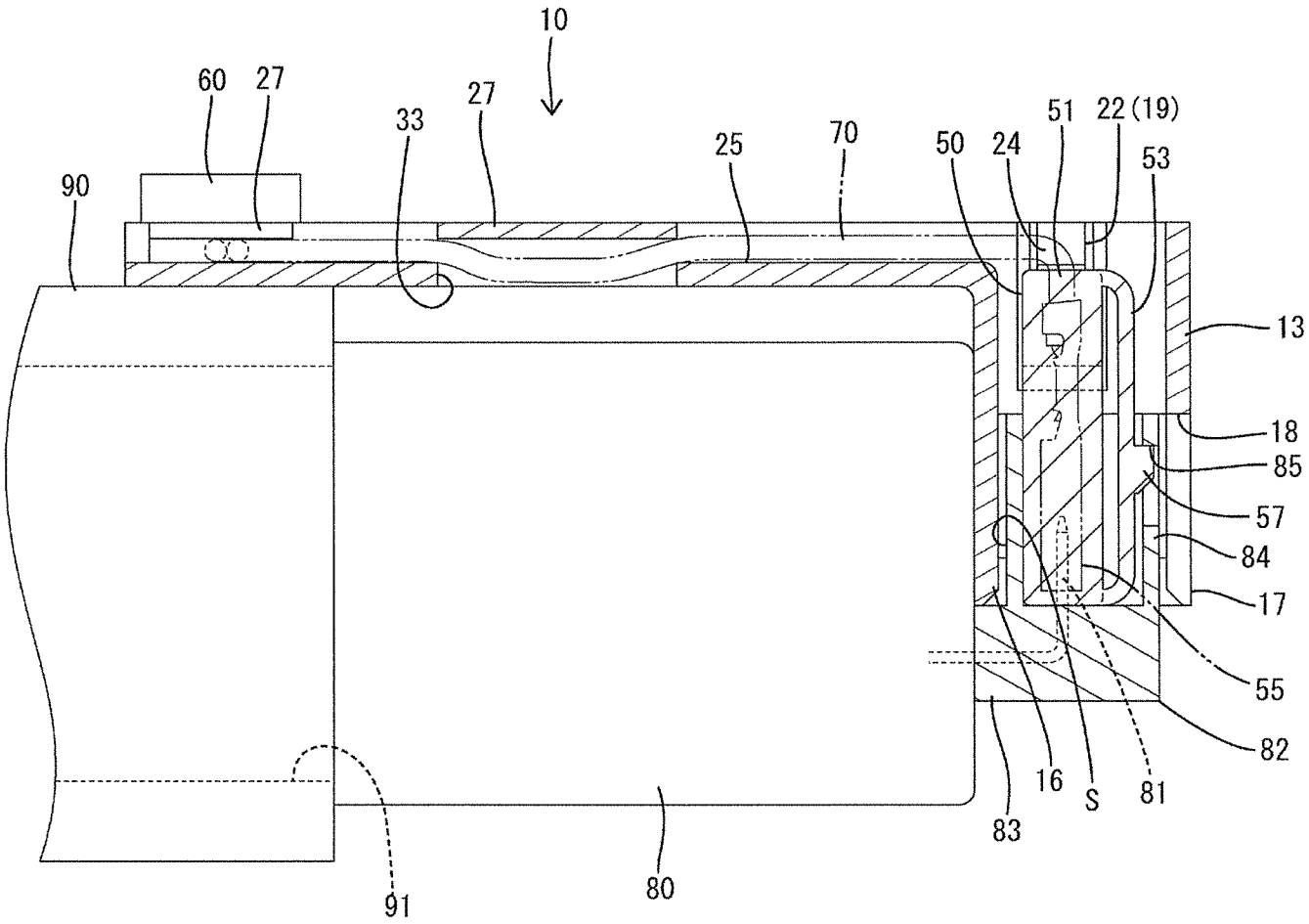
FIG. 4 is a side view in section showing the state of FIG. 2.

The lock arm 53 includes a strip-like part extending in the vertical direction and a lock projection 57 projects forward at an intermediate position in an extending direction. As shown in FIG. 4, the holder-side connector 50 is held connected to the device-side connector 82 by inserting the housing 51 into the receptacle 84 of the device-side connector 82 and resiliently fitting the lock projection 57 into the lock hole 85.

Figure 8:
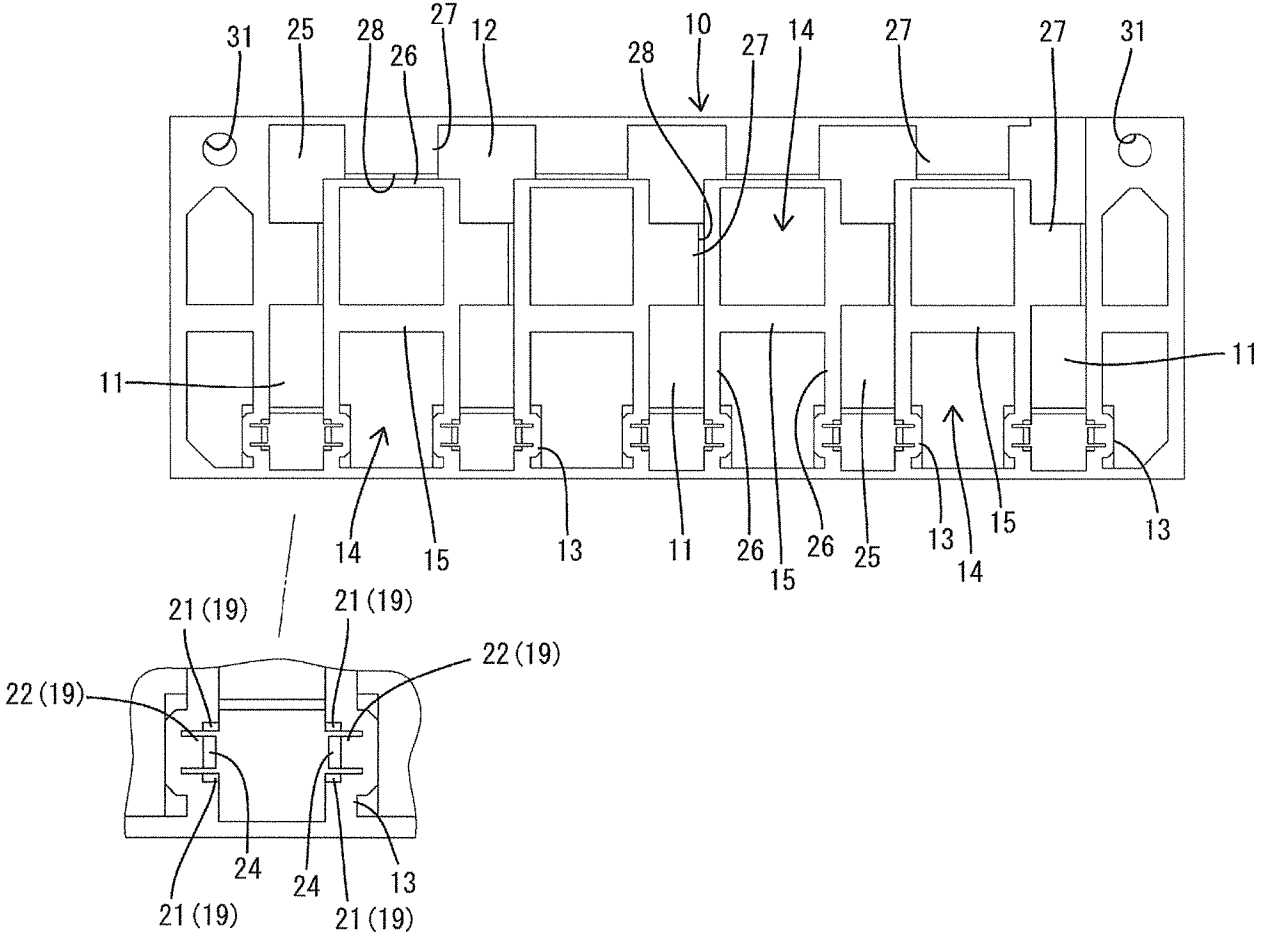
FIG. 8 is a plan view of the connector holder.

The connector holder 10 is a plate-like member made of synthetic resin and is mounted substantially horizontally on the body 90 via screws 60, as shown in FIG. 1. As shown in FIG. 8, two insertion holes 31 vertically penetrate through both left and right end parts of a rear end part of the connector holder 10 and receive the screws 60. The connector holder 10 mounted on the body 90 projects forward from the front end of the upper surface of the body 90 and faces each solenoid 80 including the device-side connector 82.

Figure 7:
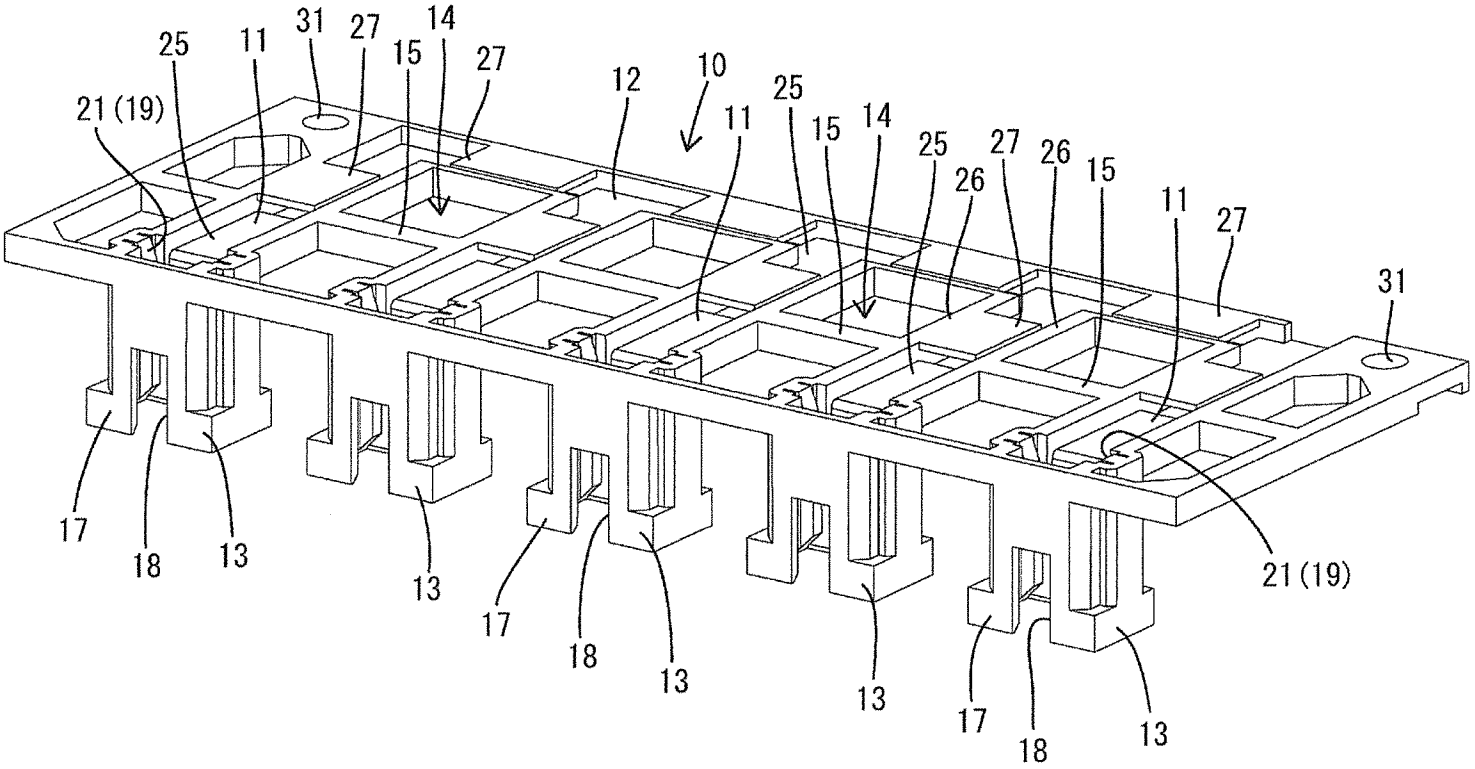
FIG. 7 is a perspective view of the connector holder.

As shown in FIG. 7, the connector holder 10 includes laterally arranged branch lines 11 in the form of shallow grooves extending in the front-rear direction, one laterally extending main line 12 in the form of a shallow groove connected to a rear part of each branch line 11, and connector inserting portions 13 in the form of downwardly projecting rectangular tubes connected to front parts of the respective branch lines 11. Spaces 14 are open between adjacent branch lines 11, and bridges 15 extend in the lateral direction across the spaces 14 and link adjacent branch lines 11.

As shown in FIG. 1, the holder-side connector 50 is inserted into the connector inserting portion 13 from above. When the connector holder 10 is mounted on the body 90, each connector inserting portion 13 is arranged to be mounted over the device-side connector 82 of the corresponding solenoid 80.

As shown in FIG. 3, a rear wall lower end part 16 of the connector inserting portion 13 is positioned and inserted into the clearance S between the front end surface of the solenoid 80 and the receptacle 84. As shown in FIG. 7, a front wall lower end part 17 of the connector inserting portion 13 is provided with a window 18 that is rectangular in a front view and open in a lower end. The lock hole 85 of the receptacle 84 is arranged inside the window 18 when the connector inserting portion 13 is mounted over the device-side connector 82. Visibility from the front of the lock projection 57 fit in the lock hole 85 of the receptacle 84 (see FIGS. 2 and 4) indicates that the holder-side connector 50 is connected properly to the device-side connector 82.

As shown in FIG. 5, two holding portions 19 are provided on both inner side surfaces of the connector inserting portion 13. The holding portion 19 is composed of lower stoppers 21 on a lower end part of the inner side surface of the connector inserting portion 13 and an upper stopper 22 on an upper end part of the inner side surface of the connector inserting 13. A moving space 23 for allowing a vertical movement of the holder-side connector 50 inserted into the connector inserting portion 13 is secured between the upper and lower stoppers 22, 21 in the holding portion 19.

The lower stopper 21 is a substantially flat step arranged to face up, as shown in FIG. 5, and two of the lower stoppers 21 are arranged on opposite sides across the upper stopper 22 when viewed from above, as shown in FIG. 8. As shown in FIG. 5, a step 29 capable of contacting the upper end part of the receptacle 84 is provided below the lower stoppers 21.

The upper stopper 22 projects in from the upper opening end of the connector inserting portion 13 and deflectable and deformable in and out in a lateral direction with the upper end of the connector inserting portion 13 as a support. A tapered inclined portion 24 is inclined down on a tip part of the upper stopper 22 in a projecting direction.

In inserting the holder-side connector 50 into the connector inserting portion 13, the engaging portions 56 of the housing body 52 slide on the inclined portions 24 to deflect and deform the upper stoppers 22. The engaging portions 56 then pass through the inclined portions 24. Thus, the upper stoppers 22 resiliently return and the engaging portions 56 enter the moving spaces 23. The engaging portions 56 are vertically movable in the moving spaces 23, restricted from coming out upward by the contact thereof with the projecting ends of the upper stoppers 22 (see FIG. 5) and restricted from coming out downward by the contact thereof with the steps of the lower stoppers 21 (see FIG. 6).

As described later, when the engaging portions 56 are at an upper end of the moving spaces 23 to contact the upper stoppers 22, the holder-side connector 50 is aligned with the device-side connector 82. When the engaging portions 56 are located at a lower end side to be able to contact with the lower stoppers 21, the holder-side connector 50 is at a push-in position to be connected properly to the device-side connector 82. Further, with the engaging portions 56 located in the moving spaces 23, the holder-side connector 50 also is loosely movable in directions intersecting the vertical direction (front-rear direction and lateral direction) within the range of the clearance between the holder-side connector 50 and the connector inserting portion 13.

As shown in FIG. 7, the branch lines 11 and the main line 12 include conductor supporting surfaces 25 constituting groove bottoms for supporting the wires 70 and rib-like partitioning portions 26 extending in a length direction of the wires 70 and defining both sides of the conductor supporting surfaces 25. The partitioning portions 26 are coupled integrally to the bridges 15, and the partitioning portions 26 and the bridges 15 form a rectangular frame shape.

Further, the branch lines 11 and the main line 12 are provided with conductor restricting pieces 27 in the form of rectangular plates each projecting from the upper end of one partitioning portion 26 toward the other partitioning portion 26, out of the partitioning portions 26 on both sides across the conductor supporting surface 25. As shown in FIGS. 2 and 4, the conductor restricting piece 27 can cover the wires 70 supported on the conductor supporting surface 25 from above and restrict a lifting of the wires 70. In the illustrated case, one conductor restricting piece 27 is provided in one branch line 11 and a plurality of the conductor restricting pieces 27 are provided substantially at fixed intervals in the main line 12. The upper surfaces of the conductor restricting pieces 27 are continuous and flush with those of the partitioning portions 26 and the bridges 15 at the same height.

Figure 9:
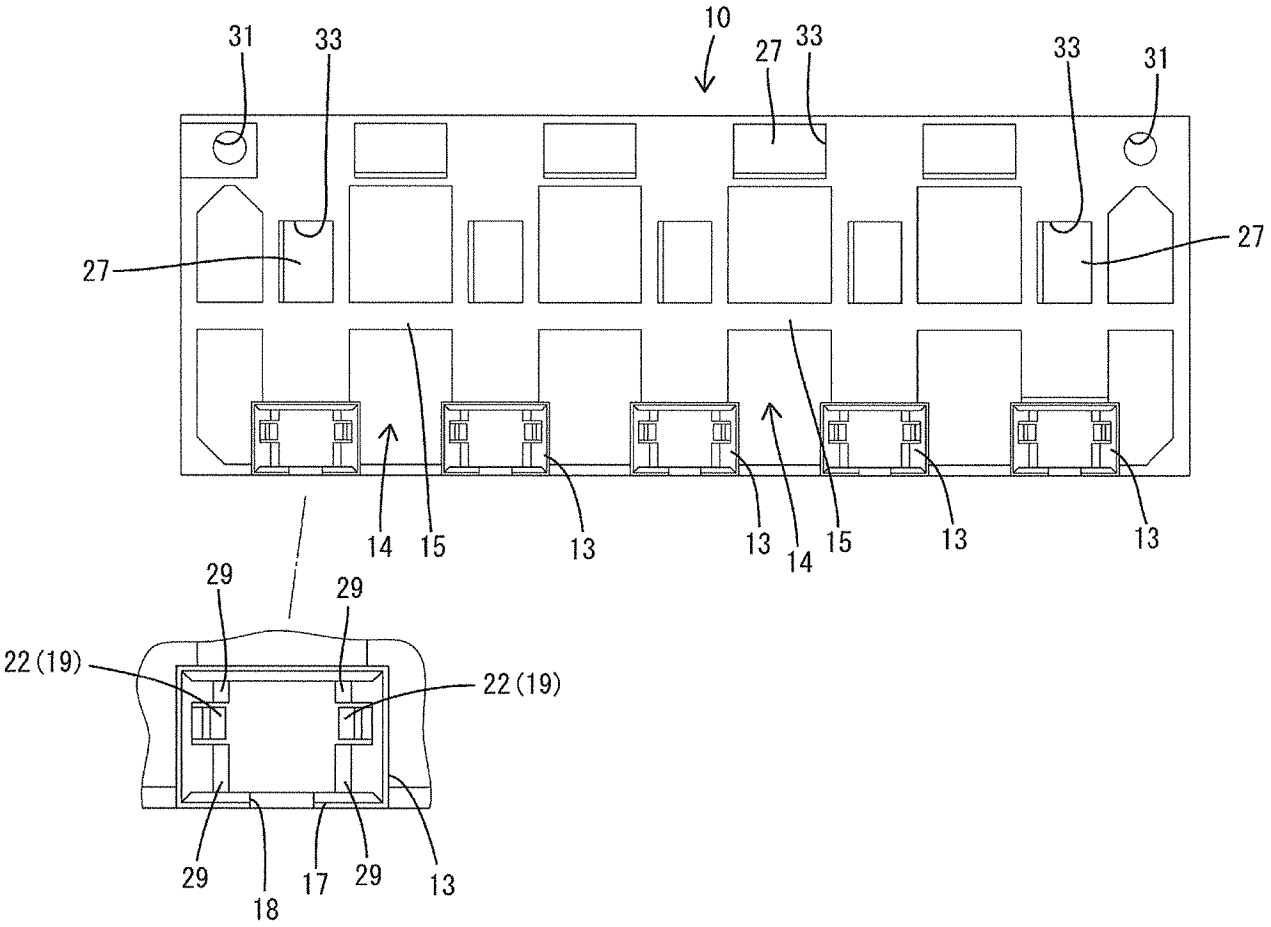
FIG. 9 is a bottom view of the connector holder.

A slit-like inlet 28 (see FIG. 8) is open between the projecting end of the conductor restricting piece 27 and the other partitioning portion 26 for introducing the wires 70 onto the conductor supporting surface 25. Further, as shown in FIG. 9, a part facing the conductor restricting piece 27, out of the groove bottom constituting the conductor supporting surface 25, is vertically hollow as a mold removal hole 33 through which a mold for forming the conductor restricting piece 27 passes.

Next, functions and effects of this embodiment are described.

In assembling, the solenoid 80 is inserted into each valve inserting portion 91 of the body 90 while being allowed to rotate about an axis.

Further, the terminal fittings 55 are inserted into the housing 51 of the holder-side connector 50. Subsequently, the holder-side connector 50 is inserted into the connector inserting portion 13 of the connector holder 10 from above. The upper stoppers 22 interfere with the engaging portions 56 to be deflected and deformed. Thus, the engaging portions 56 enter the moving spaces 23, and the upper stoppers 22 resiliently return and the holder-side connector 50 is held vertically movably with respect to the holding portions 19 (see FIGS. 5 and 6). Further, the wires 70 extending from the upper end surface of the housing 51 are arranged from the corresponding branch line 11 to the main line 12 along the conductor supporting surface 25 and inserted into the inside of the conductor restricting piece 27 through the inlet 28. The conductor restricting piece 27 interferes with the wires 70 to be deflected and deformed while the wires 70 are passing through the inlet 28, and resiliently returns to cover the wires 70 from above as the wires 70 pass through the inlet 28.

Subsequently, the connector holder 10 is fixed to the body 90 of the automatic transmission by the screws 60. When the connector holder 10 is mounted on the body 90, each connector inserting portion 13 is mounted over the device-side connector 82 of each corresponding solenoid 80 from above. In this way, the holder-side connectors 50 inserted into the respective connector inserting portions 13 are arranged collectively at positions corresponding to the device-side connectors 82 of the respective solenoids 80. Note that, conversely to the above, the holder-side connector 50 may be inserted into each connector inserting portion 13 after the connector holder 10 is mounted on the body 90.

The holder-side connector 50 that is arranged by the connector holder above the device-side connector 82 is not necessarily arranged at a position precisely facing and connectable to the device-side connector 82 due to the rotation of the solenoid 80 about the axis or dimensional tolerances or errors. However, the holder-side connector 50 is movable, at the aligned position, in a range in which the engaging portions 56 are displaceable in the moving spaces 23. Thus, the lower end of the housing 51 is guided smoothly into the receptacle 84 while sliding on an upper end opening edge of the receptacle 84. When a lower end part of the housing 51 is fit into the receptacle 84 in this way, the lock projection 57 of the lock arm 53 contacts the upper end opening edge of the receptacle 84 to temporarily restrict any further downward movement of the holder-side connector 50 (see FIG. 3).

With the holder-side connector 50 located at the aligned position and the lock projection 57 held in contact with the upper end opening edge of the receptacle 84, an upper end part of the housing 51 is arranged to project partially up from an upper end opening of the connector inserting portion 13 (see FIGS. 1 and 3). From that state, a downward pressing force is applied to the upper end of the projecting upper end part of the housing 51 directly or indirectly via the wires 70 extending from the upper end of the housing 51. For example, each holder-side connector 50 individually is pushed down by an operator's fingers or the respective holder-side connectors 50 are collectively pushed down using a plate-like tool or the like.

The lock projection 57 then is separated from the upper end opening edge of the receptacle 84 and slides on the front wall inner surface of the receptacle 84 while the lock arm 53 is deflected. The housing 51 is pushed until the lower end thereof contacts the back end of the receptacle 84. The lock arm 53 then resiliently returns, and the lock projection 57 is fit into the lock hole 85 of the receptacle 84 and the holder-side connector 50 is held in a state properly connected to the device-side connector 82 (see FIG. 4). Further, the entire housing 51 is inserted in the connector inserting portion 13 when the holder-side connector 50 reaches the push-in position, and the upper end of the housing 51 is retracted down from the upper end opening edge of the connector inserting portion 13.

As just described, according to this embodiment, the respective holder-side connectors 50 can collectively reach the aligned positions corresponding to the device-side connectors 82 of the respective solenoids 80 and are aligned in a state where the connection to the device-side connectors 82 can be started by mounting the connector holder 10 on the body 90 of the automatic transmission. Thus, the connecting operation thereafter can be performed smoothly. Further, since each holder-side connector 50 reaches the push-in position to be connected to the device-side connector 82 by being pressed from the aligned position, a complicated connecting operation is not required and the operator is less likely to get confused or erroneously connect. As a result, the connecting operability of the holder-side connectors 50 can be improved.

The upper end part of the housing 51 is arranged to project up at the aligned position and the holder-side connector 50 can be brought to the push-in position by pushing this projecting part down. Thus, the connecting operation is performed easily and the connecting operability is improved. At this time, since the upper end part of the housing 51 projects from the upper end of the connector holder 10, this upper end part is distinguished easily from the surroundings and the operation will not be forgotten.

Further, the connector holder 10 has both a function as a connecting device and a function of supporting the wires 70 extending from each holder-side connector 50. Thus, the connector holder 10 need not be a device dedicated to one function. Furthermore, since the lift of the wires 70 can be restricted by the conductor restricting pieces 27, the entire device can be reduced in height and it is not necessary to perform a cumbersome operation such as the tying of the wires by a tie band or the insertion of the wires 70 into a tube.

Other embodiments of the present invention are described briefly.

For example, the holding portions may be constituted by deflectable and deformable resilient pieces, and the holder-side connector may be resiliently held with respect to the connector inserting portion by the resilient pieces and may be released from the state held by the resilient pieces and reach the push-in position by being pushed from the aligned position.

The holder-side connector may not be pushed from above and may be pushed laterally or from behind.

The device-side connector is not limited to the solenoid and may be any device provided in a hydraulic pressure sensor or the like of the automatic transmission.

A tie band or tube may be used to bundle the respective wires and the present invention does not deny the use of a tie band or the like.

For example, a busbar may be mounted as a conductive member other than the terminal fittings in the holder-side connector. In the case of mounting a busbar in the holder-side connector, the busbar is supported on the conductor supporting surface.

LIST OF REFERENCE SIGNS

10 . . . connector holder
13 . . . connector inserting portion
19 . . . holding portion
25 . . . conductor supporting surface
27 . . . conductor restricting piece
50 . . . holder-side connector
70 . . . wire
80 . . . solenoid (electrical device)
82 . . . device-side connector
90 . . . body

The invention claimed is:

1. A connector connecting device for connecting holder-side connectors to device-side connectors respectively provided in a plurality of electrical devices equipped in an automatic transmission, comprising:

a connector holder disposed on a body of the automatic transmission while holding a plurality of the holder-side connectors, the connector holder being configured to collectively arrange the respective holder-side connectors at positions corresponding to the device-side connectors;

the connector holder including holding portions each configured to hold the holder-side connector displaceably to an aligned position for aligning the holder-side connector in a state connectable to the device-side connector and a push-in position for connecting the holder-side connector to the device-side connector by the holder-side connector being pushed from the aligned position;

each of the holding portions including a pair of stopper portions spaced in a push-in direction of the holder-side connector, a moving space for allowing the holder-side connector to move toward the device-side connector being secured between the pairs of stopper portions.

2. The connector connecting device of claim 1, wherein the holder-side connector includes a part projecting from the connector holder at the aligned position.

3. The connector connecting device of claim 1 or 2, wherein the connector holder includes conductor supporting surfaces for supporting conductive members extending from the connectors.

4. A connector connecting device of claim 3, wherein the connector holder includes conductor restricting pieces provided to cover the conductive members by facing toward sides where the conductor supporting surfaces are located.

5. The connector connecting device of claim 1, wherein the connector holder includes conductor supporting surfaces for supporting conductive members extending from the connectors.

6. A connector connecting device of claim 5, wherein the connector holder includes conductor restricting pieces provided to cover the conductive members by facing toward sides where the conductor supporting surfaces are located.

* * * * *